United States Patent [19]

Ray et al.

[11] 4,362,553

[45] Dec. 7, 1982

[54] TOOL STEELS WHICH CONTAIN BORON AND HAVE BEEN PROCESSED USING A RAPID SOLIDIFICATION PROCESS AND METHOD

[75] Inventors: Ranjan Ray, Waltham, Mass.; Donald E. Polk, Washington, D.C.; Bill C. Giessen, Cambridge, Mass.

[73] Assignee: Marko Materials, Inc., North Billerica, Mass.

[21] Appl. No.: 275,629

[22] Filed: Jun. 22, 1981

Related U.S. Application Data

[63] Continuation-in-part of Ser. No. 95,381, Nov. 11, 1979, Pat. No. 4,318,733.

[51] Int. Cl.[3] ..... C22C 38/22; C22C 38/24; C22C 38/26; C22C 38/32

[52] U.S. Cl. ..... 75/0.5 BA; 75/0.5 BB; 75/126 C; 75/126 E; 75/126 F; 75/126 H; 75/126 P; 75/226; 75/251

[58] Field of Search ..... 75/0.5 BA, 0.5 BB, 126 C, 75/126 E, 126 F, 126 H, 126 P, 226, 251

[56] References Cited

U.S. PATENT DOCUMENTS 3,986,867 10/1976 Masumoto et al. ..... 75/126 C
3,990,892 11/1976 Machi et al. ..... 75/126 C
4,140,525 2/1979 Ray ..... 75/126 C
4,260,416 4/1981 Kavesh et al. ..... 75/126 C
4,318,733 3/1982 Ray et al. ..... 75/0.5 BA

*Primary Examiner*—W. Stallard
*Attorney, Agent, or Firm*—Morse, Altman, Oates & Dacey

[57] ABSTRACT

Iron base alloys containing chromium and refractory metals as well as 0.8 to 1.3 wt % boron are disclosed. The alloys are subjected to a rapid solidification processing (RSP) technique, producing cooling rates of about $10^5$ to $10^7$° C./sec. The as-quenched RSP ribbon, or powder, etc., consists primarily of a single phase with a body centered cubic structure. After appropriate heat treatments, the rapidly solidified alloys have a microstructure consisting of ultrafine hard particles of metallic carbides and borides and mixtures thereof dispersed in an iron-rich matrix. These alloys exhibit excellent corrosion resistance combined with high hardness, wear resistance and high temperature stability. These heat treated alloys have superior properties which make them suitable for many applications, where high strength and corrosion resistance are required, in particular at elevated temperature, e.g. high temperature bearings.

28 Claims, No Drawings

TOOL STEELS WHICH CONTAIN BORON AND HAVE BEEN PROCESSED USING A RAPID SOLIDIFICATION PROCESS AND METHOD

CROSS-REFERENCE TO RELATED APPLICATION

This is a continuation-in-part of Ser. No. 095,381 filed Nov. 11, 1979, now U.S. Pat. No. 4,318,733, entitled Improved Tool Steels Which Contain Boron and Have Been Processed Using A Rapid Solidification Process and Method.

BACKGROUND OF THE INVENTION

1. Field of the Invention

This invention is concerned with (a) rapidly solidified iron alloys which contain boron and combine high strength with corrosion and oxidation resistance, and, (b) the preparation of these materials in the form of powder and the consolidation of these powders (or, alternatively, the ribbon-like material produced by a rapid solidification process) into bulk parts which are heat treated to a uniform microstructure and desirable properties.

2. Description of the Prior Art

Tool steels have many important metallurgical characteristics in common. In general, metal alloys useful as tool steels exhibit high hardness and resistance to abrasion as well as, for many alloys, the retention of these attributes at high temperatures. These characteristics are obtained by the proper choice of alloy composition, generally iron based with high carbon and alloying metal content.

Tool steels with high hardness and wear resistance are also used as bearing materials. Type M50high speed steel ($Fe_{bal}Cr_4Mo_{4.25}V_1Mn_{0.25}Si_{0.2}C_{0.8}$) is widely used in high temperature aircraft bearings but has low corrosion resistance because of the low chromium content of the alloy. Type 440-C, a stainless tool steel [$Fe_{bal}Cr_{17}Mo_{0.5}Si_{0.30}Mn_{0.4}C_{1.0}$] has poor hot hardness and is usually used at room temperature. The popular bearing steel 52100 ($Fe_{bal}Cr_{1.5}Mn_{0.35}Si_{0.25}C_{1.0}$) has both poor corrosion/oxidation resistance and poor high temperature properties. Another commercial bearing steel, 14-4 Mo ($Fe_{bal}Cr_{14}Mo_4Mn_{0.1}Si_{0.1}C_{1.05}$) has good high temperature properties and corrosion resistance but is known to have poor hot workability.

Obtaining the desired properties for highly alloyed tool steels depends mainly upon control of the microstructure; generally, desirable properties are obtained from a homogeneous distribution of the carbides in a host structure having a small grain size. The complex chemical composition of tool steel makes the solidification process complicated and leads to coarse multiphase microstructures by following normal solidification procedures. Therefore, these steels possess a natural tendency for compositional segregation. Heterogeneity of structure and composition, particularly of carbide particle size and distribution, is one of the inherent problems in the production of high performance tool steels by conventional practice.

In conventional practice, an as-cast ingot exhibits a microstructure which is then somewhat broken up by hot deformation processes. However, the final product may still exhibit relatively large heterogeneities. Also, because of hot rolling, there is a tendency for grain elongation in the rolling direction and the lining up, or banding of carbide particles, which leads to anisotropic mechanical properties.

In order to minimize these problems, powder metallurgical technologies have recently been applied to the production of tool steels. Conventional powders of tool steels are produced by the atomization of the molten alloy. The faster solidification rate associated with the atomization process, compared to cast ingots, results in particles having a finer microstructure, i.e., having a carbide morphology similar to that of the conventionally cast ingot but with characteristic grain dimensions which are orders of magnitude smaller. Thus, the faster solidification rate decreases the scale of the compositional segregation associated with the solidification to a multiphase microstructure. The powders are subsequently consolidated into parts by conventional powder metallurgical techniques (see "High Speed Tool Steel By Particle Metallurgy" by A. Kasak, G. Steven and T. A. Neumeyer, Society of Automotove Engineers, Automotive Engineering Congress, Detroit, 1972 and "P/M Alternative To Conventional Processing of High Speed Steels" by T. Leven and R. P. Hervey, METALS PROGRESS, Volume 115, No. 6, June 1979, Page 31).

Because of their finer grain size, more uniform dispersion of fine carbides and improved alloy homogeneity, tool steels processed by such powder metallurgical techniques exhibit, compared to cast materials, superior performance a better response to hardening heat treatments, improved dimensional stability and improved hot workability.

During the last two decades, rapid solidification processing (RSP) (also known as rapid liquid quenching (RLQ)) techniques have been used to fabricate new materials having in some cases new and useful properties. In RSP processes, the liquid is typically cooled at rates of $\sim 10^{5°}$–$10^{7°}$ C./sec and thus solidifies in a very short period of time. The rapid solidification rate leads to a microstructure, and in some cases a metastable atomic structure, different from that obtained from standard solidification procedures. A great deal of research and development effort has been expended on amorphous metals (also referred to as metallic glasses or noncrystalline metals) made by a RSP process. Interesting new crystalline materials, including metastable crystalline phases, alloys having an ultrafine grain size and compositionally homogeneous alloys, can also be made utilizing a RSP process. Further, economical RSP methods for fabricating large quantities of metallic alloys in the form of filaments or strips are well established as the existing state-of-the-art.

Metal powders, when produced directly from the melt by conventional liquid atomization techniques, are usually cooled three to four orders of magnitude faster than a cast ingot although typically still two or more orders of magnitude slower than is possible with RSP techniques. However, improved processes are now being developed for making powders directly from the melt. For example, it has been reported (see D. J. Looft and E. C. Van Reuth; Proc. Conf. on Rapid Solidification Processing, p. 1, Reston, VA. Nov. 1977) that rapidly solidified metal powders can be made at cooling rates in excess of $10^{5°}$ C./sec by centrifugal atomization of a liquid metal stream followed by forced convective cooling. Other approaches of the production of powders at high cooling rates have been reported, for example, that of Murphy and Miller (Scripta Met., Vol. 13, pp. 673–676, 1979).

Because of the potential benefits to be gained, there has been past interest in studying the effects of RSP on tool steels. I. R. Sare and R. W. K. Honeycombe applied RSP to a commercial, molybdenum-rich high speed steel (AISI-Ml containing 8.4% Mo-1.5% W-4.1% Cr-1.1% V-0.77% C) using the method of "gun" splat quenching technique in which molten droplets are impact quenched against a cold metal substrate (see *Rapidly Quenched Metals,* N. J. Grant and B. C. Giessen, Eds., MIT Press, Cambridge, MA., 1976, pp. 179–187). The quenched high speed tool steel consisted primarily of a two phase mixture of a b.c.c. (δ-ferrite) phase and a f.c.c. (austenite) phase. J. Niewiarowski and H. Matyja also found a mixture of two or more phases in rapidly solidified tool steels made by a "piston and anvil" type splat quenching technique (see *Rapidly Quenched Metals III,* B. Canton, Ed., The Metal Society, 1978, pp. 193–197). However, neither effort produced a homogeneous alloy. Further, neither of the processes which were used is amenable to scale-up for economical commercial production.

SUMMARY OF THE INVENTION

This invention provides a class of iron alloys which have properties which make them highly useful, e.g. as components of high temperature bearings, when the production of these alloys includes a rapid solidification process. These alloys also contain chromium and refractory metals as well as between 0.8 and 1.3 wt% boron. They can be described as: $Fe_{bal}Cr_{10-20}$(Mo, W, V, Cb, Ta)$_{5-20}C_{0.8-1.3}$, where the total Cb+Ta content is generally below 5 wt%. Preferred compositions are given by $Fe_{bal}Cr_{13-16}Mo_{1-6}W_{4-12}V_{0-3}Cb_{0-2}C_{0.9-1.1}B_{0.9-1.2}$. Mn, Si and Ni generally at levels below ~2 wt%, may be present as "impurities" in the Fe. Limited amounts of other alloying elements, e.g. Co, may be present without changing the essential behavior of these alloys.

Rapid solidification processing (RSP) (i.e., processes in which the liquid alloy is subjected to cooling rates of the order of ~$10^{5°}$–$10^{7°}$ C./sec) of such alloys produces a solidified alloy having a crystalline metastable structure which is chemically homogeneous and which, after heating so as to transform the microstructure to a more stable state, has a microstructure which is more uniform and has a smaller grain size than that obtainable by conventional techniques. This transformed material can be superior to conventional high temperature tool steels.

The inclusion of boron in the alloy has several advantages. It enhances the supercooling of the liquid which is achievable and makes easier the formation of a chemically homogeneous, metastable crystalline product when RSP process is utilized. The fine borides formed in the RSP alloy after heat treatment strengthen the metal, and these borides do not dissolve at elevated operating temperatures, giving enhanced high temperature strength. Finally, the inclusion of boron makes it possible to obtain a good yield of uniform material from melt-spinning, an economical RSP process; the as-quenched melt-spun ribbons are brittle and can readily be comminuted to a powder, a form especially useful for subsequent consolidation to the transformed (ductile) final product.

DETAILED DESCRIPTION OF THE PREFERRED EMBODIMENT

In accordance with the invention, iron base alloys containing 10 to 20 wt% Cr, 5 to 20 wt% of one or more of the refractory elements Mo, W, V, Cb and Ta, 0.8 to 1.3 wt%C and 0.8 to 1.3 wt%B, plus incidental impurities, are rapidly solidified (at cooling rates of ~$10^{5°}$–$10^{7°}$ C./sec) from the melt by known standard methods, most readily by melt spinning which consists of contacting the molten alloy against the rapidly moving surface (~6000 ft/min.) of a chill substrate made of a material of high thermal conductivity, such as copper, precipitation hardened copper beryllium alloy, etc. The rapidly solidified ribbons generally consist almost entirely of a single homogeneous iron-rich solid solution phase with a b.c.c. crystal structure. This Fe rich phase (ferrite) is metastable and highly supersaturated, containing essentially all of the alloying elements (most significantly the carbon and boron), plus whatever incidental impurities are present, as a solid solution. The rapidly solidified ribbons are brittle, i.e., they fracture when bent to a radius of curvature less than 50–100 times the thickness of the ribbon. The brittle ribbons can be mechanically comminuted to powders of desirable size ranges, preferably below 100 mesh, which are convenient for subsequent consolidation. The powders can be hot consolidated to fully dense structural bodies by suitable known metallurgical techniques such as hot isostatic pressing, hot extrusion, hot rolling, hot forging, hot swaging and the like. During consolidation or as a separate step, the powders are heat treated between 500° and 1400° F. for between 0.1 to 10 hours to cause the supersaturated iron-rich b.c.c. phase (ferrite) to decompose into solute lean ferrite and ultrafine particles (e.g., ~0.1 to 1 microns in diameter) of metallic carbides, MC, $M_2C$, $M_3C$, $M_6C$, $M_{23}C_7$ and the like, and metallic borides MB, $M_2B$, $M_3B$, $M_6B$ and the like, and mixtures thereof, where M is one or more of W, Mo, V, Cb, Ta, Cr and Fe. Subsequent to consolidation, the consolidated parts are annealed using practices similar to those used for standard tool steels. From the annealed stocks, products of various geometries are machined and heat-treated (i.e., hardened and tempered) by methods similar to those used for commercial tool steels. The hardened and tempered parts made from the alloys in accordance with the present invention have hardness values ranging between ~680 and 775 VHN.

Alternatively, the rapidly solidified powders can be heat treated between 500° and 1300° F. to cause decomposition of the metastable solid solution phase with precipitation of fine carbides and borides and mixtures thereof. The heat treated powders subsequently can be further softened by further annealing treatment similar to that applied to commercial tool steels. The fully annealed powders can be readily cold pressed into suitable shapes, sintered, hot forged or hot isostatically pressed to 100% or almost 100% full density, hardened and tempered to hardness ranging between ~680 and 775 VHN according to standard practices.

It is noted that rapid solidification processing and subsequent consolidation of these alloys can be carried out in many alternative ways so as to achieve the same final result. For example, RSP powders can be made directly from the melt using one of the RSP-powder processed discussed above. Further, the as-quenched ribbons could be consolidated without first being converted to a powder, either as-formed or after only a partial breaking up into smaller pieces.

The fully treated alloys made in accordance with the present invention can have higher temper hardness as compared to corresponding commercial bearing steels. In addition, the alloys made under the present invention have a microstructure which is much more homogeneous than that hithereto achieved by the present state-of-the-art.

The above described boron-modified alloys, processed by RSP, are preferred because commercial high performance steels, e.g. bearing steels, produced by conventional techniques have certain limitations due to a heterogeneous distribution of carbide particles of non-uniform sizes. Large carbide particles in a hard matrix, such as the tool steel matrix, act as internal notches and cause a decrease in the wear resistance of the steels. Furthermore, the presence of large and irregular undissolved carbide particles in segregated patterns can cause (1) anisotropic mechanical properties, (2) dimensional instability during heat treatment cycles, (3) poor grindability, (4) longer soaking time necessary to dissolve carbides in the austenite (f.c.c.) phase during austenitizing heat treatment cycle leading to coarse grain size and hence poor impact strength, and, (5) decreased performance and lifetime. Tool steels fabricated by consolidation of inert gas of water atomized powders possess improved properties, compared to ingot-cast material, because of improved chemical homogeneity and finer microstructure. However, the present alloys are superior still to the tool steels made from conventionally atomized powders.

High hardness, high thermal stability, uniformly dispersed particles of borides and carbides make the present boron modified steels from desirable and useful for practical applications. A generalized composition of the modified steels of the present invention is given as follows: (subscripts in wt%)

$Fe_{bal}Cr_{10-20}(Mo, W, V. Cb, Ta)_{5-20}C_{0.8-1.3}B_{0.8-1.3}$, where the total (Cb+Ta) content is generally less than 5 wt%, and where Mn, Ni and Si may be present generally at levels below 2 wt%, as impurities in the iron.

Other incidental impurities may also be present, as well as other metals commonly alloyed with iron, e.g. Co at a level of ~10 wt%, without changing the essential behavior of these alloys. Preferred compositions are given by $Fe_{bal}Cr_{13-16}Mo_{1-6}W_{4-12}V_{0-3}Cb_{0-2}C_{0.9-1.1}B_{0.9-1.2}$. With no boron present, the above alloys are similar to commercial stainless high speed steels. In the boron containing alloys, the metal borides, as well as hard MC carbides of the type VC or NbC, produced enhances wear resistance and hot hardness.

In contrast to the above boron-modified alloys, commercial bearing steels or stainless high speed steels cannot be readily fabricated from the melt as rapidly solidified ribbons, using the conventional melt spinning described above. Attempts to melt spin the commercial bearing steels M50, 440C and 14-4 Mo type alloys into rapidly quenched ribbons using a rotating Cu-Be cylinder at 18 5000 ft/min, were unsuccessful. The molten conventional steels did not wet the metallic substrate used in melt-spinning and hence did not form a stable puddle in contact with the rapidly moving surface of the chill substrate, a condition essential to form a ribbon. Molten jets of these commercial steels upon impingement onto the rotating surface of the chill substrate at the surface speed of 4000–8000 ft/min, broke up into coarse molten droplets, globules or "stringers" which left the wheel while still molten and thus were not quenched rapidly because of insufficient time in contact with the substrate.

In comparison, the boron-modified iron base alloys of the alloys of the present invention can be rapidly solidified as continuous ribbons of uniform quenching of the product throughout. The presence of boron at levels greater than ~0.4 wt% was found to be critical to the processability of the alloys using melt-spinning of the alloys in order to get the best quality ribbons. Boron contents above ~0.8 wt% are preferred in order to get the most desirable properties in the heat treated alloy. Even above 1.5 wt% boron, the alloys continue to exhibit excellent ribbon fabricability. However, the rapidly solidified ribbons of alloys having more than ~1.3 to 1.5 wt%B become at least partially amorphous and ductile. Such ductile ribbons with high hardness (>1000 VHN) are not readily mechanically comminuted into powders. More importantly, when the boron content exceeds about the upper limit of the range within the scope of the invention, the consolidated alloys became too enriched in boride content and grain hardness at the expense of toughness, i.e., the total boron and carbon content is too high. The preferred boron content is between 0.9 and 1.2 wt%. The given iron base alloys with the preferred amounts of boron are cast easily as rapidly solidified brittle ribbons with essentially homogeneous crystalline microstructures. The brittle ribbons are easily converted into powders. Fully dense parts consolidated from the powders can then be heat treated to achieve excellent properties for applications requiring high hot hardness and corrosion oxidation and wear resistance as well as other applications where "tool steels" are useful. The brittle as-quenched alloy becomes ductile after suitable heat treatment.

X-ray diffraction examinations of the atomic structure of a number of the as-quenched rapidly solidified boron-containing alloys were made. A single metastable b.c.c. crystalline phase was retained upon rapid quenching. As the boron content in the alloys increased above ~1.3 to 1.5 wt% (depending on the other alloying elements), an amorphous phase began to appear and coexisted with the crystalline phase, in the as-cast condition. At higher boron contents, the amount of the amorphous phase increases. Thus, the RSP process, when applied to these complex alloys of the present invention, yield a metastable crystalline product having high chemical homogeneity as a result of diffusionless solidification.

Furthermore, the rapidly quenched crystalline ribbons are found to be brittle, i.e. to exhibit low ductility. Ductility of a material is the ability to deform plastically without fracture. As well known to those skilled in the art, ductility can be measured by elongation or reduction in area in a tensile test or by other conventional means. The degree of brittleness of ribbons or filaments can be most readily characterized by a simple bend test. For example, metallic ribbon can be bent to form a loop and the diameter of the loop is gradually reduced until the loop is fractured. The breaking diameter of the loop is a measure of ductility. The smaller the breaking diameter for a given ribbon thickness, the more ductile the ribbon is considered to be. The as-quenched ribbons, typically ~0.0015 inches thick generally had breaking diameters ~0.1" and thus are quite brittle.

It is noted that while the as-quenched homogeneous, metastable phase is very brittle, subsequent heat treatments which cause phase transformations can be used to transform the alloy to a ductile, tough state having very desirable mechanical properties, i.e., high strength, high hardness and good wear resistance. Because of the high chromium content of the present alloys, they also exhibit very good oxidation and corrosion resistence.

In another embodiment, the as-quenched, rapidly solidified, brittle ribbons are mechanically comminuted by known equipment and procedures into powders of desirable size ranges for subsequent powder metallurgical processing steps. Milling equipment suitable for comminution of the brittle ribbons include ball mills, rod mills, hammer mills, fluid energy mills, and the like. If desired, comminution can be performed under protective inert atmosphere or in vacuum to prevent oxidation. Another type of mill suitable for the comminution of the brittle ribbons is an impact pulverizer which consists of a rotor assembly fitted with hammers and which is operated at high rotor speeds. The grinding action is one of impact between rapidly moving hammers and the materials being ground, the energy of the hammers dissipating itself into particles by virtue of inertia, thus causing the brittle particle to break into pieces, resulting in a reduction in particle sizes.

Following comminution the powder may be screened, if desired, (e.g., through a 100 mesh screen so as to give a powder size convenient for powder metallurgical processing) in order to remove oversize particles. The powders can be further separated into desired particle fractions; for example, into under 325 mesh powder and powder of particle size between 100 and 325 mesh.

It is possible to consolidate the powders by suitable powder metallurgical techniques into fully dense structural parts. For example, the rapidly solidified powders of the boron-containing iron alloys can be packed in a container (e.g., one of mild steel) which is then evacuated and sealed off. The container is preheated to temperatures between ~500° and 1400° F., preferably between 1000° and 1200° F., for sufficient lengths of time (typically between 0.1 and 10 hours) to cause precipitation of ultrafine metallic carbides such as MC, $M_2C$, $M_{23}C_7$, and the like, and metallic borides such as MB, $M_2B$, $M_6B$, and the like, and mixtures thereof, with particle size between ~0.1 and 1 micron, preferably between 0.1 and 0.3 micron. This treatment markedly softens the alloy. The subsequent consolidation and heat treatments, described below, are similar to those which would be used for standard tool steels.

Next, the container is heated to temperatures between 1750° to 2200° F., at which temperature consolidation is made easier. The container is hot isostatically pressed into ingots, discs, rings, blocks and the like, hot extruded into ingots, bars, rods and the like, hot rolled into plates, strips, sheets, hot forged or hot swaged into any desired shape. The borides remain as such during this step, while the carbon is partly in solution and partly present as carbides of the alloying elements.

The hot consolidated products can be obtained as a softened alloy at room temperature by controlling the cooling process correctly to avoid martensite. For example, the alloy can be annealed between 1500° and 1700° F., followed by slow cooling at 50°-100° F./hour to 800°-1000° F., preferably to 900° F., followed by air cooling to room temperature. The annealed stocks may have hardness between 250 to 400 VHN, generally not more than 300 VHN. The annealed microstructure consists of a mixture of ferrite, spherodized, relatively coarse carbide particles, fine alloy-carbide particles and fine boride particles.

Components of any desired geometry may be machined from the annealed stocks and subsequently heat treated, i.e., hardened and tempered, to give the final hard part of desired properties. The hardening treatment is similar to that used for conventional tool steels and can be carried out by heating the parts at temperatures between 1800° and 2150° F., preferably between 1900° and 2050° F., followed by cooling in air, oil or water below the austenite (f.c.c. phase) field to martensite (body centered tetragonal phase) transformation temperature. The hardened alloys typically have a hardness in the range 800-1050 VHN. The hardened tools can be subsequently tempered at temperatures between 550° and 1100° F. to obtain the desired toughness. In fully heat-treated (i.e. hardened and tempered) conditions, the alloys typically have a hardness between 660-780 VHN.

The boron plays a critical role in the alloys processed in accordance with the present invention. Boron has negligible solid solubility in iron. Iron or steel containing boron in the range as in the preset alloys will have undesirable mechanical properties when conventionally cast due to the presence of a massive, brittle eutectic boride network. By rapid quenching from the melt, boron is included in the metastable solid solution of the ferrite phase (b.c.c.) along with the carbon and other alloying metals.

During the initial heating (preferably at 1000°-1200° F.) of the as-quenched material below the ferrite to austenite phase (f.c.c.) transformation temperature, i.e., the austenitization temperature, supersaturated ferrite decomposes into solute lean ferrite and fine precipitates of alloy carbides and alloy borides. During heating above the austenitization temperature in the consolidation or hardening heat treatment steps, preferably between 1850° and 2050° F., borides remain undissolved while some carbides are taken into solution in the austenite phase. From this state, the alloys can be solid state quenched, i.e., hardened, to transform austenite into martensite, a body-centered tetragonal phase highly supersaturated with carbon. The hardened microstructure having very high hardness consists of fine borides and excess carbides dispersed uniformly throughout a martensitic matrix. The hardened alloys can be tempered by heat treatment between 550° and 1100° F. to cause martensite to decompose into ferrite and fine alloy carbides. In one configuration, the fully heat-treated boron-containing steels produced in accordance with the present invention consists of an extremely uniform microstructure of fine dispersion of excess alloy carbides and borides in a fine grained tempered martensite. Such microstructure gives rise to high hardness, toughness, wear resistance and improved response to hardening heat treatment and superior dimensional stability. Such properties make these materials useful for application where conventional tool steels are now used or wherever high strength alloys, especially those retaining strength at high temperatures, are useful.

Furthermore, in accordance with the present invention, the rapidly solidified alloys, e.g., in the form of powder, can be softened by annealing so as to be suitable for cold compaction. The as-quenched material is first heated at 500°-1400° F. (preferably 1000°-1200° F.) to precipitate the ultrafine carbides and borides. This material is then annealed at 1500° to 1750° F. followed by slow cooling at 50°-100° F./hour to 800°-1000° F. followed by air cooling to room temperature. The annealed powders are soft (typically ~300 VHN) and have microstructures consisting of fine spherodized carbides, boride particles and ferrite. The annealed powders are cold compactable and can be pressed at 30,000-60,000 psi into any desired shape having green density and strength sufficient for normal handling. The green compacts are subsequently sintered and hot forged or hot isostatically pressed to full density. The fully dense bodies are subsequently heat treated, i.e., hardened and tempered, to the desired combination of hardness and toughness for practical applications. The formed parts in the fully heat treated condition (i.e., hardened and tempered made in accordance with the present invention have hardness in the range 660 to 780 VHN.

The microstructures of the alloys of the present invention are at least one order of magnitude finer and are more homogeneous than the microstructures of the high speed steels produced by the present state-of-the-art. Superior mechanical properties, excellent corrosion, oxidation and wear resistance, and high temperature stability of the present alloys, due to the refined microstructure and boron content of the present alloys, will make them suitable for many applications, e.g. high temperature bearings.

EXAMPLES 1-18

A number of alloys having compositions within the scope of the invention, as given in Table 1, were fabricated as ribbons having the thicknesses of ~0.0015-0.0020 inches by the RSP method of melt spinning using a rotating Cu-Be cylinder having a quench surface speed of ~5000 ft/min. The alloys were found to exhibit excellent ribbon fabricability. The ribbons were found by X-ray diffraction analysis to consist predominately of a metastable single solid solution phase with b.c.c. crystal structure. The as-quenched ribbons were found to have breaking diameters of >0.1 and thus are quite brittle, being amenable to ready comminution to powder.

EXAMPLE 19

A number of alloys selected from Table 1 were subsequently subjected to hardening and tempering heat treatments as commonly applied to commercial tool steels. The hardening treatment of the melt spun ribbons included heat treatment (austenitizing) at 1950° F. followed by air cooling to room temperature. Following the hardening treatment, the ribbons were found to have high Vickers hardness values as shown in Table 2. The ribbons also showed considerably improved bend ductility as compared to their as-quenched bend ductility. Further improvement in bend ductility of the ribbons was achieved with some decrease in hardness values by a double tempering heat treatment which involved heating the hardened ribbons twice at 1100° F. for two hours, followed by air cooling to room temperature each time.

The hardness values of the alloys of the present invention after the tempering treatment are given in Table 2.

The microstructure of the fully heat treated (i.e. hardened and tempered) ribbons consisted of an extremely fine grained tempered martensite uniformly dispersed with ultrafine metallic boride particles.

EXAMPLE 20

Table 3 lists the compositions of several commercial bearing steels and Table 4 shows the effect of tempering temperature on room temperature hardness. (See T. V. Philip, in Metal Progress, February 1980, page 52). In Table 4, shown as comparison are the hardness values of two alloys (Alloy No. 1B and Alloy No. 7B as listed in Table 1) within the scope of the present invention, also as a function of tempering temperature. The tempered hardness values of the present alloys are higher than those of the commercial steels.

EXAMPLE 21

Thermal stability of one of the typical alloys IB ($Fe_{70.24}Cr_{13.3}Mo_{1.7}V_{1.4}Cl_{1.18}W_{10}C_{1.09}B_{1.09}$) was compared to two commercial bearing steels NM-100 ($Fe_{bal}Cr_{17.5}W_{10.5}Co_{9.5}V_{0.75}C_{1.25}$) and 440-C ($Fe_{bal}Cr_{17}Mo_{0.5}Mn_{0.4}Si_{0.3}$). Table 5 lists the room temperature hardness values of a fully heat treated alloy 1B of the present invention, of NM-100 and of 440-C, after static exposure to 1000° F. for different lengths of time (see Source Book on Materials Selection, Vol. 11, ASM, Metals Park, Ohio, page 68). The alloy No. 1B retained higher hardness values than the commercial bearing steels.

EXAMPLE 22

Approximately 6 pounds of an alloy (18B) of the present invention having the composition $Fe_{68.47}Cr_{16.2}V_{1.4}Mo_{1.73}W_{10.03}C_{1.1}B_{1.09}$ was melt spun into rapidly cast brittle ribbons. The ribbons were pulverised into −100 mesh powder by a rotary hammer mill. The powders were packed into a 2" O.D. mild steel can and sealed off under vacuum. The can was heated at 1900° F. for three hours and extruded at an extrusion ratio of 10:1 into a fully consolidated (100% dense) rod.

EXAMPLE 23

An example is given here for a method for continuous production of rapidly solidified powders of steels having compositions within the present invention. The alloys are melted in an electric arc or induction melting furnace. The molten metal is transferred from the furnace into a ladle and then poured into a tundish with a multiple number of orifices. The molten jets are generated from the tundish and impinge on a moving surface of water cooled chill substrate whereby rapidly solidified ribbons are produced at a rate of ~6000 ft/min. The ribbons are fed into a pulverized (hammer mill) of required capacity directly off the substrate and thereby reduced to powder.

TABLE 1

| EXAMPLE | ALLOY NO. | COMPOSITION (wt %) |
|---|---|---|
| 1 | 1B | $Fe_{70.24}Cr_{13.3}Mo_{1.7}V_{1.4}Cb_{1.18}W_{10}C_{1.09}B_{1.09}$ |
| 2 | 2B | $Fe_{66.9}Cr_{15.14}Mo_{0.87}V_{2.78}Cb_{0.34}W_{11.7}C_{1.09}B_{1.18}$ |
| 3 | 3B | $Fe_{66.95}Cr_{15.1}Mo_{0.84}V_{2.3}Cb_{0.84}W_{11.68}C_{1.09}B_{1.17}$ |
| 4 | 4B | $Fe_{67.89}Cr_{13.09}Mo_{.87}V_{3.62}Cb_{0.84}W_{11.57}C_{1.16}B_{0.97}$ |
| 5 | 5B | $Fe_{69.43}Cr_{14.8}Mo_{3.64}W_{6.97}Cb_{0.88}V_{1.91}C_{1.14}B_{1.23}$ |
| 6 | 6B | $Fe_{68.07}Cr_{13.14}Mo_{3.47}W_{9.97}Ta_{1.83}V_{1.37}C_{0.98}B_{1.17}$ |
| 7 | 7B | $Fe_{72.58}Cr_{14.59}Mo_{1.8}W_{6.88}Cb_{0.86}C_{1.12}B_{1.22}$ |
| 8 | 8B | $Fe_{70.43}Cr_{15.26}V_{1.18}W_{8.44}Cb_{0.84}C_{1.1}B_{0.99}$ |
| 9 | 9B | $Fe_{69.27}Cr_{15.41}Mo_{3.55}W_{6.81}Cb_{0.85}V_{1.89}C_{1.11}B_{1.11}$ |
| 10 | 10B | $Fe_{71.98}Cr_{16.55}Mo_{1.73}W_{6.86}Cb_{0.68}V_{1.9}C_{1.11}B_{1.11}$ |
| 11 | 11B | $Fe_{69.94}Cr_{14.26}W_{10.01}V_{2.79}Cb_{0.83}C_{1.09}B_{0.99}$ |
| 12 | 12B | $Fe_{70.63}Cr_{14.3}W_{8.4}Mo_{3.52}V_{0.93}C_{1.1}B_{1.09}$ |
| 13 | 13B | $Fe_{75.19}Cr_{13.34}W_{6.72}Mo_{1.73}V_{0.93}C_{1.1}B_{0.99}$ |
| 14 | 14B | $Fe_{73.17}Cr_{15.26}W_{6.72}Mo_{1.72}V_{0.94}C_{1.1}B_{1.09}$ |
| 15 | 15B | $Fe_{72.3}Cr_{13.34}V_{1.4}Mo_{0.86}W_{10.01}C_{1.1}B_{0.99}$ |
| 16 | 16B | $Fe_{70.67}Cr_{16.2}V_{0.93}W_{10.03}C_{1.1}B_{1.07}$ |
| 17 | 17B | $Fe_{72.46}Cr_{15.3}Mo_{8.65}V_{1.4}C_{1.1}B_{1.09}$ |
| 18 | 18B | $Fe_{68.47}Cr_{16.2}V_{1.4}Mo_{1.73}W_{10.03}C_{1.1}B_{1.09}$ |

TABLE 2

| Hardness values after heat treatments (hardening and tempering) of selected alloys as listed in Table 1. | | |
|---|---|---|
| | VICKER'S HARDNESS (VHN) (Kg/mm$^2$) | |
| ALLOY NO. | Hardening Treatment: heated at 1950° F. for 1 hour followed by air cooling to room temperature. | Double Tempering at 1100° F. for 2 hours following hardening treatment. |
| 1B | 923 | 762 |
| 2B | 938 | 767 |
| 3B | 825 | 678 |
| 5B | 852 | 683 |
| 6B | 626 | 680 |
| 7B | 1049 | 777 |
| 8B | 811 | 707 |
| 12B | 854 | 712 |
| 13B | 850 | 685 |
| 14B | 793 | 669 |
| 15B | 872 | 725 |
| 16B | 996 | 743 |
| 17B | 920 | 736 |

TABLE 3

| STEEL | COMPOSITION |
|---|---|
| CRB-7 | $Fe_{Bal}$ $Cr_{14}$ $Mo_2$ $V_1$ $Cl_{0.25}$ $C_{1.1}$ $Mn_{0.35}$ $Si_{0.3}$ |
| M - 50 | $Fe_{Bal}$ $Cr_4$ $Mo_{4.25}$ $V_1$ $Mn_{0.25}$ $Si_{0.2}$ |
| 440 - C | $Fe_{Bal}$ $Cr_{17}$ $Mo_{0.5}$ $Mn_{0.4}$ $Si_{0.3}$ |
| 14-4 Mo | $Fe_{Bal}$ $Cr_{14}$ $Mo_4$ $Mn_{0.4}$ $Si_{0.3}$ |

TABLE 4

| Effect of Tempering Temperature on room temperature hardness | | | | | | |
|---|---|---|---|---|---|---|
| | HARDNESS (ROCKWELL C) | | | | | |
| TEMPERING TEMPERATURE | CRB - 7 | 14-4Mo | 440 C | M-50 | Alloy No. 1 B of the present invention. | Alloy No. 7 B of the present invention |
| As hardened before tempering | 64 | 63.5 | 60.5 | 66 | 67.5 | 69 |
| 600° F. | 62 | 61 | 57.5 | 60 | 65 | 66 |
| 1000° F. | 58 | 58 | 52 | 62 | 63 | 65 |
| 1100° F. | 54 | 50 | 41 | 60 | 63 | 63 |

TABLE 5

| Hardness Values after static exposure time at 1000° F. | | | |
|---|---|---|---|
| STATIC EXPOSURE TIME | HARDNESS (ROCKWELL C) | | |
| (HOURS AT 1000° F.) | Alloy No. 1B | NM-100 | 440 |
| 0 | 63 | 64 | 60.5 |
| 200 | 59 | 57 | 50 |
| 330 | 59 | 57 | 47 |

We claim:

1. The iron base alloys having compositions described by the generalized formula $Fe_{Bal}Cr_{10-20}M_{5-20}C_{0.8-1.3}B_{0.8-1.3}$, where M is at least one of the group consisting of Mo, W, V, Cb and Ta, and where the iron may also contain incidental impurities.

2. The alloys of claim 1 wherein the total of Cb and Ta content is less than 5 wt%.

3. The alloys of claim 1 containing 6–12 wt% W.

4. The alloys of claim 1 wherein upto 10 wt% of the Fe is replaced by Co.

5. The alloys of claim 1 containing 0.95 to 1.25 wt% boron and 1.0 to 1.1 wt% carbon.

6. The iron base alloys having compositions described by the generalized formula, $Fe_{Bal}Cr_{13-16}Mo_{1-6}W_{4-12}V_{0-3}Cb_{0-2}C_{0.9-1.1}B_{0.9-1.2}$.

7. The alloys of claim 1 wherein said alloy is prepared from the melt thereof by a rapid solidification process characterized by cooling rates in the range of about $10^5$ to $10^7$ °C./Sec. and consisting predominantly of metastable crystaline phases.

8. The alloys of claim 7 in one of filament, ribbon and sheet form.

9. The alloys of claim 7 in powder form.

10. The alloys of claim 7 having predominately a body centered cubic structure and hardness ranging between 800 and 1050 VHN (Kg/mm$^2$).

11. Alloys of claim 1 having a microstructure consisting of ultrafine metallic carbides and metallic borides and mixtures thereof uniformly dispersed in an iron rich matrix.

12. Alloys according to claim 11 wherein said metallic carbide and boride particles have an average particle size measured in its largest dimension of less than 1 micron.

13. Alloys according to claim 11 wherein said metallic carbides and borides have an average particle size measured in its largest dimension of less than 0.3 micron.

14. The alloys according to claim 11 in powder form.

15. The alloys according to claim 11 in filament form.

16. Alloys of claim 6 consisting of a fine grained iron rich matrix uniformly dispersed with metallic carbides and metallic borides and mixtures thereof and wherein said carbide and boride particles have an average particle size measured in its largest dimension of less than 0.3 micron.

17. Alloys according to claim 16 in powder form.

18. Alloys according to claim 16 in filament form.

19. Alloy bodies according to claim 12 having a thickness of at least 0.1 millimeter measured in the shortest dimension.

20. Alloy bodies of claim 19 consisting of 0.95 to 1.25 wt% boron and 1.0 to 1.1 wt% carbon.

21. The alloy bodies of claim 19 consisting of 6 to 12 wt% tungsten.

22. A method of fabricating alloys of claim 1 in powder form having predominantly a body centered cubic structure which comprises: (a) forming a melt of the material, (b) contacting said melt against a rapidly moving quench surface so as to quench the melt at a rate of about $10^5$ to $10^7$ °C./Sec. and (c) comminuting said quenched alloy to a powder.

23. The method of claim 22 in which the quench rate is greater than $10^6$ °C./Sec.

24. The method of claim 22 wherein the quenched alloy has a hardness ranging between 800 and 1050 Kg/mm$^2$.

25. The method of claim 22 wherein the powder has particle sizes less than 4 mesh (U.S. Standard) and consists of platelets having a thickness of less than 0.1 millimeter, each platelet being defined by an irregularly shaped outline resulting from fracture.

26. A method of making alloys of claim 22 consisting of heating the alloy of claim 7 to temperatures between 500° and 1400° C. for 0.1 to 10 hours.

27. The method of claim 26 wherein the alloys of claim 7 are heated between 1200° and 1300° F. for 2 hours.

28. A method of making alloy bodies of claim 19 which comprises: (a) fabricating the alloy in the shape of one of filament and powder using rapid solidification processing, and (b) subjecting said shape simultaneously to heat and pressure to affect both consolidation and transformation of the microstructure to one containing the metallic carbides and borides.

* * * * *